US009370947B2

(12) United States Patent
Samoto

(10) Patent No.: US 9,370,947 B2
(45) Date of Patent: Jun. 21, 2016

(54) IMAGE RECORDING APPARATUS

(71) Applicant: Brother Kogyo Kabushiki Kaisha, Nagoya-shi, Aichi-ken (JP)

(72) Inventor: Kenji Samoto, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 14/984,467

(22) Filed: Dec. 30, 2015

(65) Prior Publication Data

US 2016/0107464 A1 Apr. 21, 2016

Related U.S. Application Data

(63) Continuation of application No. 14/798,962, filed on Jul. 14, 2015, now Pat. No. 9,227,431, which is a continuation of application No. 14/613,476, filed on Feb. 4, 2015, now Pat. No. 9,085,180, which is a continuation of application No. 14/187,837, filed on Feb. 24, 2014, now Pat. No. 8,955,964, which is a continuation of application No. 13/617,100, filed on Sep. 14, 2012, now Pat. No. 8,702,227.

(30) Foreign Application Priority Data

Nov. 28, 2011 (JP) ..... 2011-259569

(51) Int. Cl.

| | |
|---|---|
| ***B41J 11/00*** | (2006.01) |
| ***B41J 13/10*** | (2006.01) |
| ***B41J 13/14*** | (2006.01) |
| ***B41J 13/02*** | (2006.01) |

(52) U.S. Cl.

CPC ..... *B41J 13/02* (2013.01); *B41J 11/0045* (2013.01); *B41J 13/10* (2013.01); *B41J 13/14* (2013.01)

(58) Field of Classification Search

CPC combination set(s) only.
See application file for complete search history.

(56) References Cited

U.S. PATENT DOCUMENTS

| | | | | |
|---|---|---|---|---|
| 8,702,227 | B2 | 4/2014 | Samoto | |
| 8,955,964 | B2 | 2/2015 | Samoto | |
| 9,085,180 | B2 | 7/2015 | Samoto | |
| 9,227,431 | B2 * | 1/2016 | Samoto | B41J 11/0045 |
| 2002/0067942 | A1 | 6/2002 | Sugiyama | |
| 2003/0025777 | A1 | 2/2003 | Sugiyama | |
| 2003/0048345 | A1 | 3/2003 | Matsumoto | |
| 2004/0126164 | A1 | 7/2004 | Ohyama | |

(Continued)

FOREIGN PATENT DOCUMENTS

| | | | |
|---|---|---|---|
| JP | H10-71711 | A | 3/1998 |
| JP | H11-138923 | A | 5/1999 |
| JP | 2000-071532 | A | 3/2000 |

(Continued)

*Primary Examiner* — Huan Tran
(74) *Attorney, Agent, or Firm* — Banner & Witcoff, Ltd.

(57) ABSTRACT

An image recording apparatus for recording an image on a sheet includes a recording section which records the image on the sheet in a transport passage for transporting the sheet in a transport direction; and a plurality of holding members which are provided while being separated from each other in a widthwise direction of the transport passage perpendicular to the transport direction and which press the sheet transported along the transport passage, from at least one of front and back surfaces of the sheet. At lease one holding member, which is provided at a central portion in the widthwise direction of the transport passage, is arranged on a downstream side in the transport direction as compared with the other holding members.

4 Claims, 9 Drawing Sheets

(56) References Cited

U.S. PATENT DOCUMENTS

| | | | |
|---|---|---|---|
| 2005/0168557 | A1 | 8/2005 | Ohyama |
| 2011/0001778 | A1 | 1/2011 | Kanda et al. |

FOREIGN PATENT DOCUMENTS

| | | | |
|---|---|---|---|
| JP | 2000-158644 | A | 6/2000 |
| JP | 2010-143662 | A | 7/2010 |

* cited by examiner

IMAGE RECORDING APPARATUS

CROSS REFERENCE TO RELATED APPLICATION

The present application is a continuation of prior U.S. application Ser. No. 14/798,962, filed Jul. 14, 2015, which is a continuation of prior U.S. application Ser. No. 14/613,476, filed Feb. 4, 2015, issued as U.S. Pat. No. 9,085,180 on Jul. 21, 2015, which is a continuation of prior U.S. application Ser. No. 14/187,837, filed Feb. 24, 2014, issued as U.S. Pat. No. 8,955,964 on Feb. 17, 2015, which is a continuation of prior U.S. application Ser. No. 13/617,100, filed Sep. 14, 2012, issued as U.S. Pat. No. 8,702,227 on Apr. 22, 2014, which claims priority from Japanese Patent Application No. 2011-259569 filed on Nov. 28, 2011, the disclosures of which are incorporated herein by reference in its entirety.

BACKGROUND OF THE INVENTION

1. Field of the Invention

The present invention relates to an image recording apparatus which is capable of recording an image on a sheet transported along a transport passage.

2. Description of the Related Art

An image recording apparatus, which is capable of recording an image on a sheet, is provided with a transport passage for the sheet therein in most cases. In the image recording apparatus, the sheet is interposed by roller pairs, and thus the sheet is transported along the transport passage. For example, an ink-jet printer is known as an image recording apparatus which is provided with a recording section for recording an image by discharging inks from an upward position to the sheet, and a platen provided under or below the recording section with a transport passage intervening therebetween for supporting the sheet.

A member for pressing the sheet (hereinafter referred to as "holding member") is provided for the transport passage in order to move the sheet along the transport passage. The holding member prevents the sheet from being separated from the transport passage. The holding member is exemplified, for example, by a roller or a spur.

It is especially important to prevent the sheet from being separated from the transport passage when an image is recorded. Therefore, the holding member is used in order to press the sheet toward the platen. Accordingly, it is possible to prevent the sheet from the floating during the image recording. Japanese Patent Application Laid-open No. 2000-71532 discloses an ink-jet recording apparatus which is constructed such that a sheet is pressed toward a platen by means of a plurality of projections 16 (holding members) provided in a direction perpendicular to a transport direction of the sheet.

Usually, the roller pairs for transporting the sheet are provided on the upstream side and the downstream side of the recording section respectively. When the sheet is transported, and the upstream end of the sheet passes through the upstream side roller pair, then the sheet is in a state of being interposed by only the downstream side roller pair. In the ink-jet recording apparatus disclosed in Japanese Patent Application Laid-open No. 2000-71532, the holding members are provided on the just downstream side of the upstream side roller pair (feeding side driving roller 8 and registration roller 9). Therefore, when the upstream end of the sheet passes through the holding members, the sheet is interposed by only the downstream side roller pair (discharge side driving roller 20 and discharging spur 21).

In the case of the arrangement in which the plurality of holding members are provided in the direction perpendicular to the transport direction of the sheet as in the ink-jet recording apparatus disclosed in Japanese Patent Application Laid-open No. 2000-71532, the timings, at which the sheet is released from the pressing state effected by the holding members when the upstream end of the sheet passes completely through the holding members, are not completely simultaneous with each other in relation to all of the holding members in some cases. For example, when the sheet obliquely travels during the transport, and the pressing state, which is effected by the holding member disposed on the most outer side, is maintained to the last, then the force, with which the sheet is transported by the roller pair, acts as the angular moment (rotation moment) to rotate the sheet about the support point of the pressing position at which the sheet is pressed by the concerning holding member. For example, if the pressing state, which is effected by the holding member disposed at the left end as viewed from the downstream side, is maintained to the last, the sheet is rotated clockwise about the support point of the pressing position. Therefore, it is feared that the sheet may be more inclined with respect to the angle at which the sheet is to be transported. If the sheet is inclined, the image is recorded in a state of being inclined with respect to the sheet.

SUMMARY OF THE INVENTION

The present invention has been made taking the foregoing problem into consideration, an object of which is to provide such a structure or arrangement that a sheet is prevented from being inclined during the transport in a system or mechanism provided with a plurality of holding members.

According to an aspect of the present invention, there is provided an image recording apparatus which is configured to record an image on a sheet; the apparatus including a recording section which is configured to record the image on the sheet in a transport passage for transporting the sheet in a transport direction; and a plurality of holding members which are provided while being separated from each other in a widthwise direction of the transport passage perpendicular to the transport direction and which press the sheet transported along the transport passage, from at least one of front and back surfaces of the sheet; wherein at least one holding member, which is provided at a central portion in the widthwise direction of the transport passage, is arranged on a downstream side in the transport direction as compared with the other holding members.

The holding member, which is herein referred to in the present invention, is appropriately any member which presses the sheet, wherein the shape thereof and the pressing method are not limited. For example, the holding member may be a flat plate-shaped plate. Alternatively, the holding member may be either a roller or a spur. The phrase "central portion in the widthwise direction of the transport passage" means not only the center in the widthwise direction of the transport passage but also the area including vicinity areas disposed on the both sides of the center in the widthwise direction as well.

The sheet, which is transported along the transport passage, is maintained at the position at which the sheet should be primarily disposed, by being pressed by the holding members. When the sheet passes through the holding members, the upstream end of the sheet completely passes through the holding member provided at the central portion in the widthwise direction of the transport passage after completely passing through the other holding members, because at least one holding member, which is provided at the central portion in the widthwise direction of the transport passage, is positioned on the downstream side as compared with the other holding members. That is, the pressing state, which is effected by the holding member provided at the central portion in the widthwise direction of the transport passage, is maintained to the last. Therefore, the force in the transport direction does not act on the sheet while being directed to any one of the sides in the widthwise direction of the transport passage. In other words, the action of the angular moment (rotation moment) to incline the sheet is avoided.

According to the image recording apparatus concerning the present invention, it is possible to prevent the sheet from being inclined when the upstream end of the sheet passes through the holding members.

BRIEF DESCRIPTION OF THE DRAWINGS

FIGS. 5A to 5F show a holding member, wherein FIG. 5A shows a plan view, FIG. 5B shows a left side view, FIG. 5C shows a front view, FIG. 5D shows a right side view, FIG. 5E shows a perspective view, and FIG. 5F shows a bottom view.

FIG. 8A shows a state provided immediately before the inclination, and FIG. 8B shows a state provided after the inclination.

DESCRIPTION OF THE PREFERRED EMBODIMENTS

Figure 1:
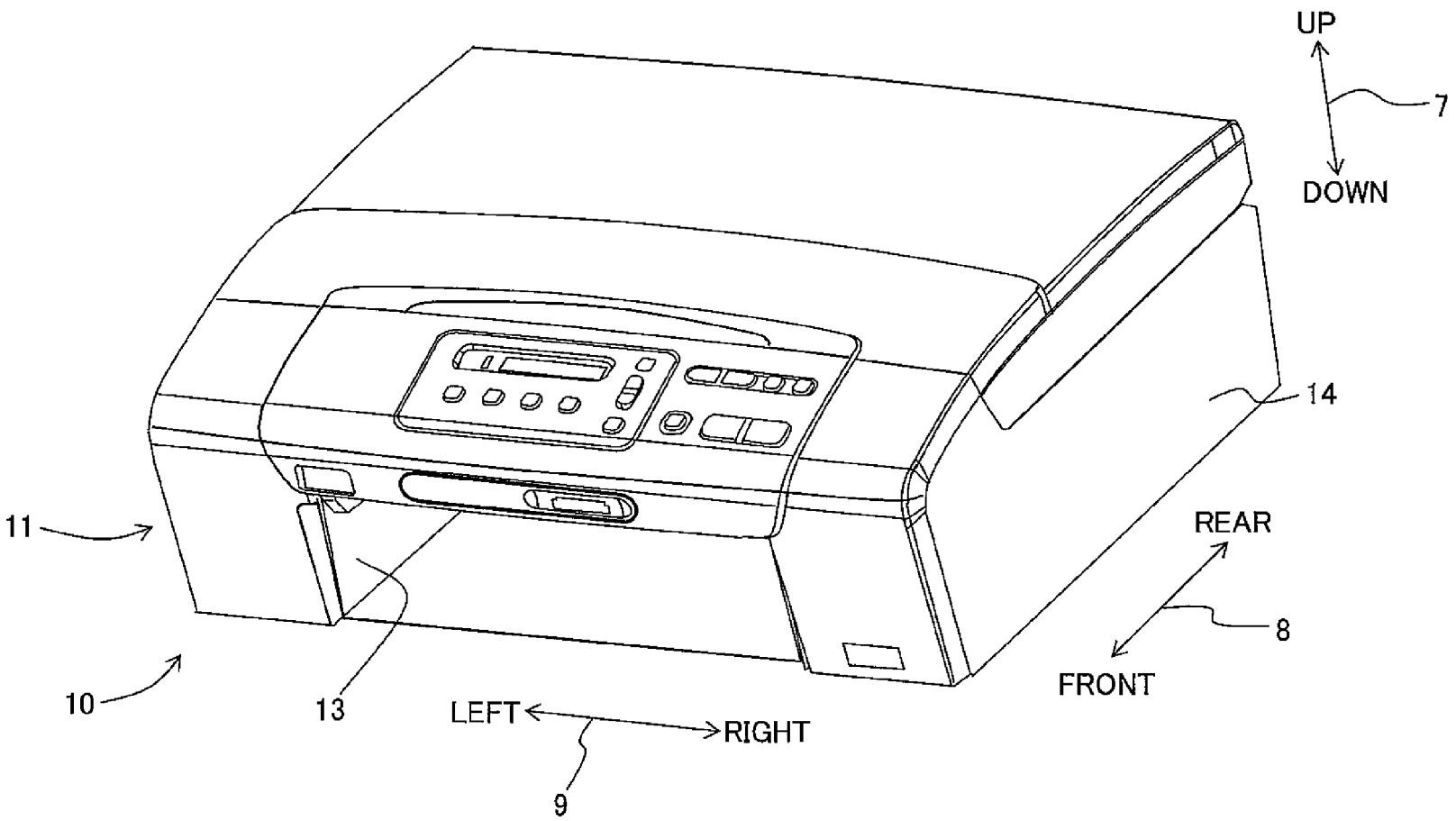
FIG. 1 shows a perspective view illustrating a multifunction machine according to an embodiment of the present invention.

An embodiment of the present invention will be explained below appropriately with reference to the drawings. The embodiment explained below is merely an example of the present invention. It goes without saying that the embodiment of the present invention can be appropriately changed or modified within a range without changing the gist or essential characteristics of the present invention. In the following description, the upward-downward direction 7 is defined on the basis of the state (state shown in FIG. 1) in which a multifunction machine 10 is installed usably. The front-back direction 8 is defined assuming that the side, on which an opening 13 is provided, is the front side (front), and the left-right direction 9 (example of the widthwise direction of the present invention) is defined while the multifunction machine 10 is viewed from the front side (front).

As shown in FIG. 1, the multifunction machine 10 is generally formed to have a thin type rectangular parallelepiped form. A printer unit 11, which is based on the ink-jet recording system, is provided at a lower portion of the multifunction machine 10. The multifunction machine 10 has various functions including, for example, the facsimile function and the print function for recording an image on the recording paper 35 (example of the sheet of the present invention). The presence or absence of the function other than the print function is arbitrary. The printer unit 11 has a casing (housing) 14 which has the opening 13 formed on the front. A tray 20, on which the recording paper 35 having various sizes can be placed, can be inserted/withdrawn in the front-back direction 8 through the opening 13. In other words, the tray 20 can be installed and removed with respect to the multifunction machine 10.

<Arrangement of Printer Unit>

Figure 2:
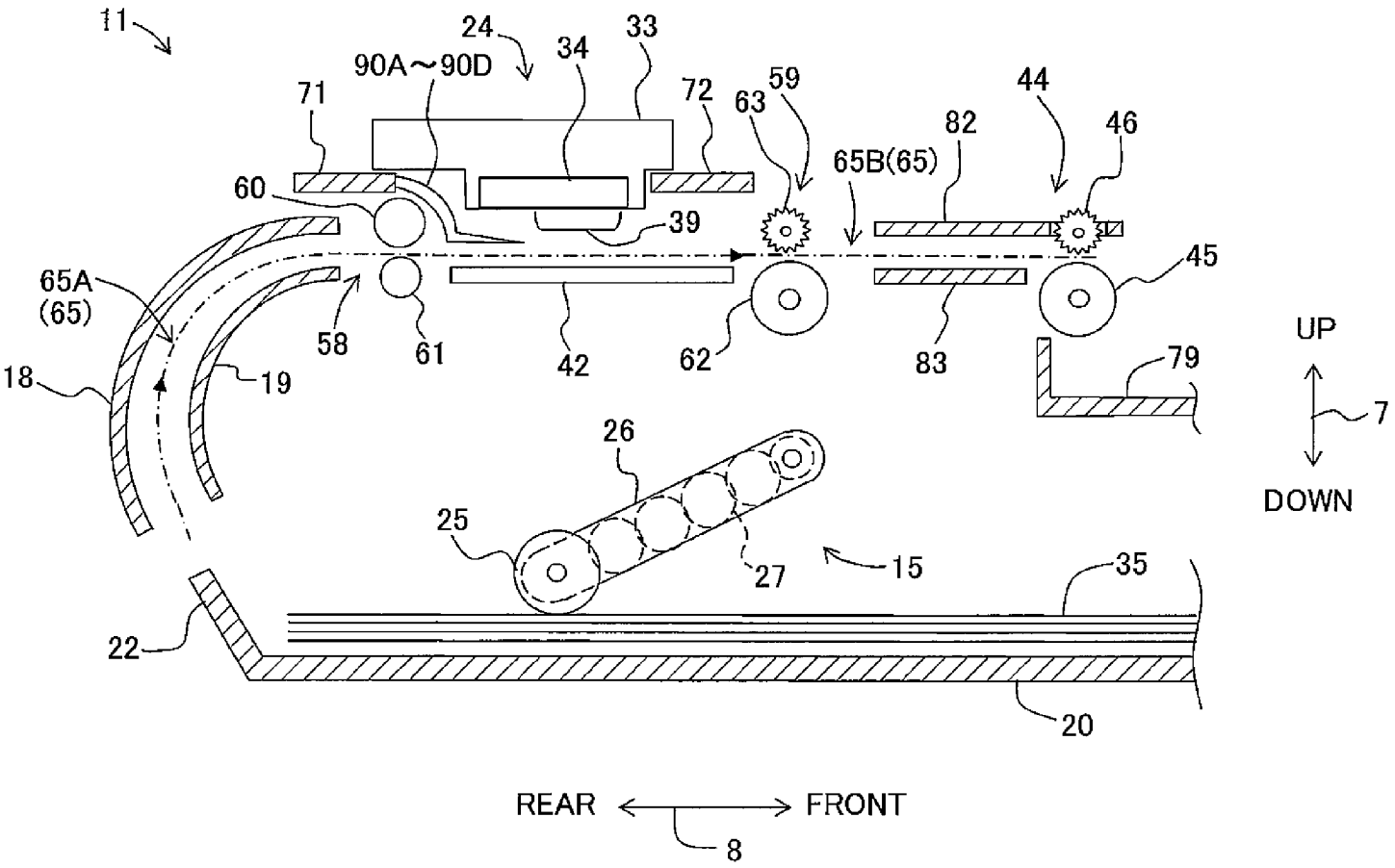
FIG. 2 schematically shows an arrangement of a printer unit.

As shown in FIG. 2, the printer unit 11 is provided with, for example, a paper feed unit 15 which picks up the recording paper 35 from the tray 20 and which feeds the recording paper 35, and a recording section 24 (example of the recording section of the present invention) based on the ink-jet recording system which is provided over or above the tray 20 and which records the image on the recording paper 35 by discharging ink droplets onto the recording paper 35 fed by the paper feed unit 15.

<Paper Feed Unit 15>

As shown in FIG. 2, the paper feed unit 15 is provided under or below the recording section 24 over or above the tray 20. The paper feed unit 15 is provided with a paper feed roller 25, a paper feed arm 26, and a driving transmission mechanism 27. The paper feed roller 25 is rotated by transmitting the driving force of a paper feed motor (not shown) by means of the driving transmission mechanism 27 in which a plurality of gears are meshed with each other. The paper feed roller 25 supplies the recording paper 35 to a curved passage 65A as described later on.

<Transport Passage 65>

As shown in FIG. 2, a transport passage 65 (example of the transport passage of the present invention), which ranges from the forward end (end portion disposed on the back side) of the tray 20 via the recording section 24 to arrive at a discharged paper retaining unit 79, is formed in the printer unit 11. The transport passage 65 is divided into the curved passage 65A which is formed between the forward end of the tray 20 and the recording section 24, and a paper discharge passage 65B which is formed between the recording section 24 and the discharged paper retaining unit 79.

The curved passage 65A is the passage having a curved shape provided to extend from a portion disposed in the vicinity of the upper end of a separating inclined plate 22 provided for the tray 20 to the recording section 24. The curved passage 65A is generally formed to have a circular arc-shaped form having the center disposed on the inner side of the printer unit 11. The recording paper 35, which is fed from the tray 20, is guided to the position disposed just under the recording section 24 while being curved in the transport direction in the transport direction along the curved passage 65A (orientation of the arrow affixed to the alternate long and short dash line shown in FIG. 2, example of the transport direction of the present invention). The curved passage 65A is comparted by an outer guide member 18 and an inner guide member 19 which are opposed to one another while being separated from each other by a predetermined spacing distance. Any one of the outer guide member 18, the inner guide member 19, and respective guide members 82, 83 described later on is allowed to extend in the direction perpendicular to the paper surface of FIG. 2 (left-right direction 9 shown in FIG. 1).

The paper discharge passage 65B is the linear or straight line-shaped passage provided to extend from the position disposed just under the recording section 24 to the discharged paper retaining unit 79. The recording paper 35 is guided in the transport direction along the transport passage 65B. The paper discharge passage 65B is formed by the recording section 24 and a platen 42 (example of the platen of the present invention) which are opposed to one another while being separated from each other by a predetermined spacing distance at the portion at which the recording section 24 is provided. The paper discharge passage 65B is comparted by the upper guide member 82 and the lower guide member 83 which are opposed to one another while being separated from each other by a predetermined spacing distance at the portion at which the recording section 24 is not provided.

<Recording Section 24>

Figure 3:
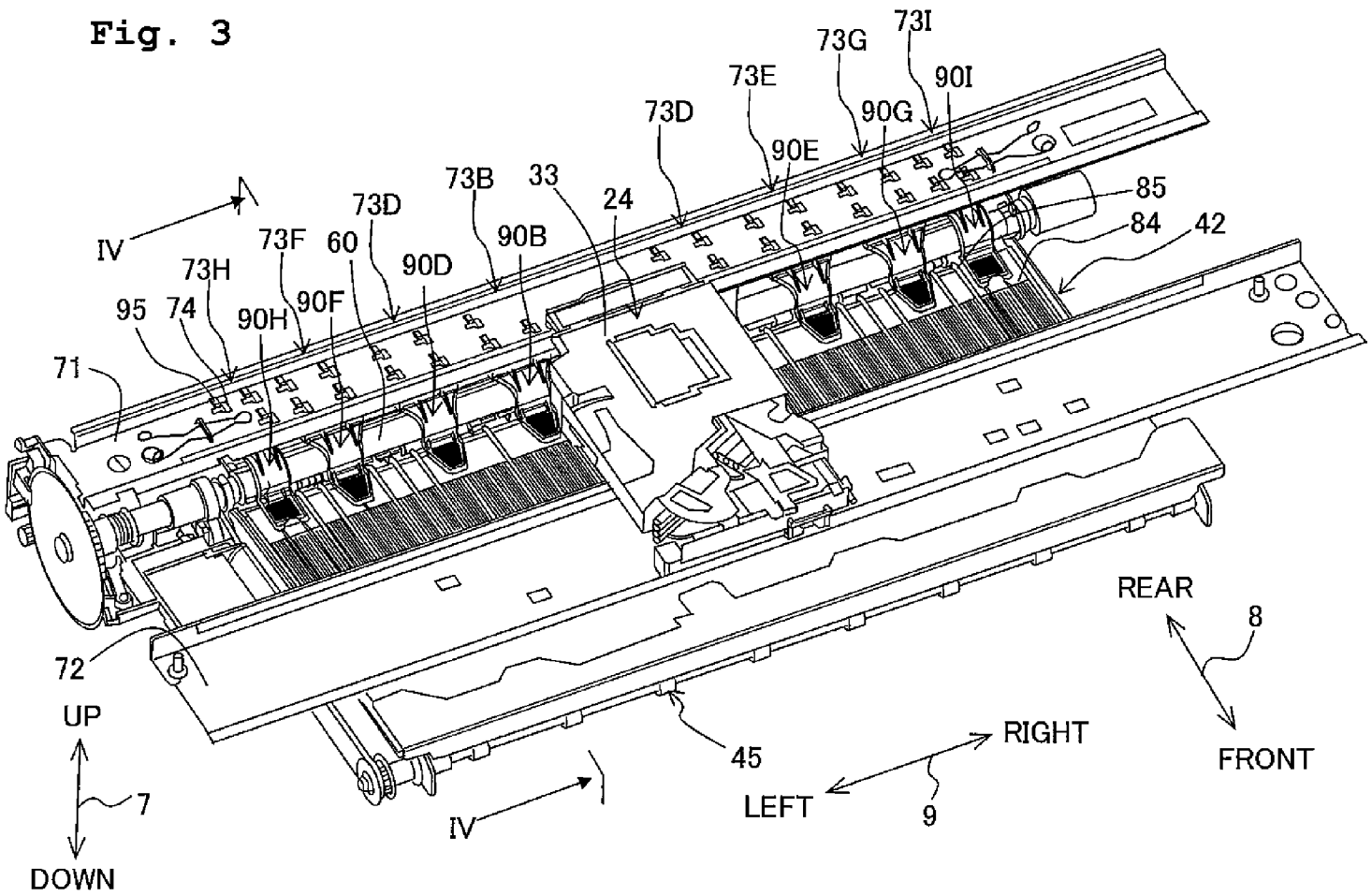
FIG. 3 shows a perspective view illustrating those disposed around a recording section.

As shown in FIGS. 2 and 3, the recording section 24 is arranged over or above the tray 20 (FIG. 2). The recording section 24 has a carriage 33, and a recording head 34 (FIG. 2) which is carried on the carriage 33. The carriage 33 is supported while spanning a first guide rail 71 and a second guide rail 72. The first guide rail 71 and the second guide rail 72 have substantially flat plate-shaped forms in which the left-right direction 9 is the longitudinal direction. The first guide rail 71 and the second guide rail 72 are provided while being separated from each other in the front-back direction 8 at approximately the same height position in the upward-downward direction 7. The carriage 33 is reciprocatively movable in the left-right direction 9 together with the recording head 34 along the first guide rail 71 and the second guide rail 72.

The platen 42, which is provided to horizontally retain, i.e., support the recording paper 35, is provided at the position opposed to the recording section 24 while interposing the transport passage 65 under or below the recording section 24. The recording head 34 discharges inks supplied from ink cartridges (not shown) from a plurality of nozzles 39 (example of the nozzle of the present invention) provided between the first guide rail 71 and the second guide rail 72 to the recording paper 35 transported on the platen 42 during the process of the reciprocative movement in the left-right direction 9. Accordingly, the image is recorded on the recording paper 35 in the transport passage 65. Detailed arrangements of the platen 42 and the first guide rail 71 will be described in detail later on.

<Transport Rollers 45, 60, 62>

As shown in FIG. 2, a first roller pair 58, which is composed of a first transport roller 60 and a pinch roller 61, is provided between the recording section 24 and the downstream ends in the transport direction of the outer guide member 18 and the inner guide member 19. The pinch roller 61 is arranged under the first transport roller 60. The pinch roller 61 is brought in contact with the roller surface of the first transport roller 60 under pressure by an elastic member such as an unillustrated spring or the like. The recording paper 35, which is transported along the curved passage 65A, is interposed by the first roller pair 58, and the recording paper 35 is fed onto the platen 42.

A second roller pair 59 (example of the roller pair of the present invention), which is composed of a second transport roller 62 and a spur 63, is provided between the platen 42 and the upper guide member 82 and the lower guide member 83, i.e., on the downstream side in the transport direction from the platen 42. The spur 63 is arranged over the second transport roller 62. The spur 63 is brought in contact with the roller surface of the second transport roller 62 under pressure by an elastic member such as an unillustrated spring or the like. The second roller pair 59 is arranged while allowing the nip position to be disposed closely to the platen 50. The recording paper 35, on which the image has been recorded by the recording section 24, is transported to the downstream side in the transport direction while being interposed by the second transport roller 62 and the spur 63.

The rotational driving force is transmitted from a transport motor (not shown) via a driving transmission mechanism (not shown) to the respective transport rollers 60, 62, and thus the respective transport rollers 60, 62 are rotated. The driving transmission mechanism is composed of, for example, a planet gear. Even when the transport motor is rotated in any one of the positive rotating direction and the negative rotating direction, each of the transport rollers 60, 62 is rotated in one rotating direction. Accordingly, the recording paper 35 is transported in the transport direction.

A third roller pair 44, which is composed of a third transport roller 45 and a spur 46, is provided on the downstream side in the transport direction from the second roller pair 59. The spur 46 is arranged over the third transport roller 45, and the spur 46 is brought in contact with the roller surface of the third transport roller 45 under pressure by an elastic member such as an unillustrated spring or the like.

The driving force is transmitted from the transport motor, and the third transport roller 45 is rotated. Accordingly, the recording paper 35 is transported to the downstream side in the transport direction by being interposed by the third transport roller 45 and the spur 46, and the recording paper 35 is discharged to the discharged paper retaining unit 79.

<Platen 42>

Figure 4:
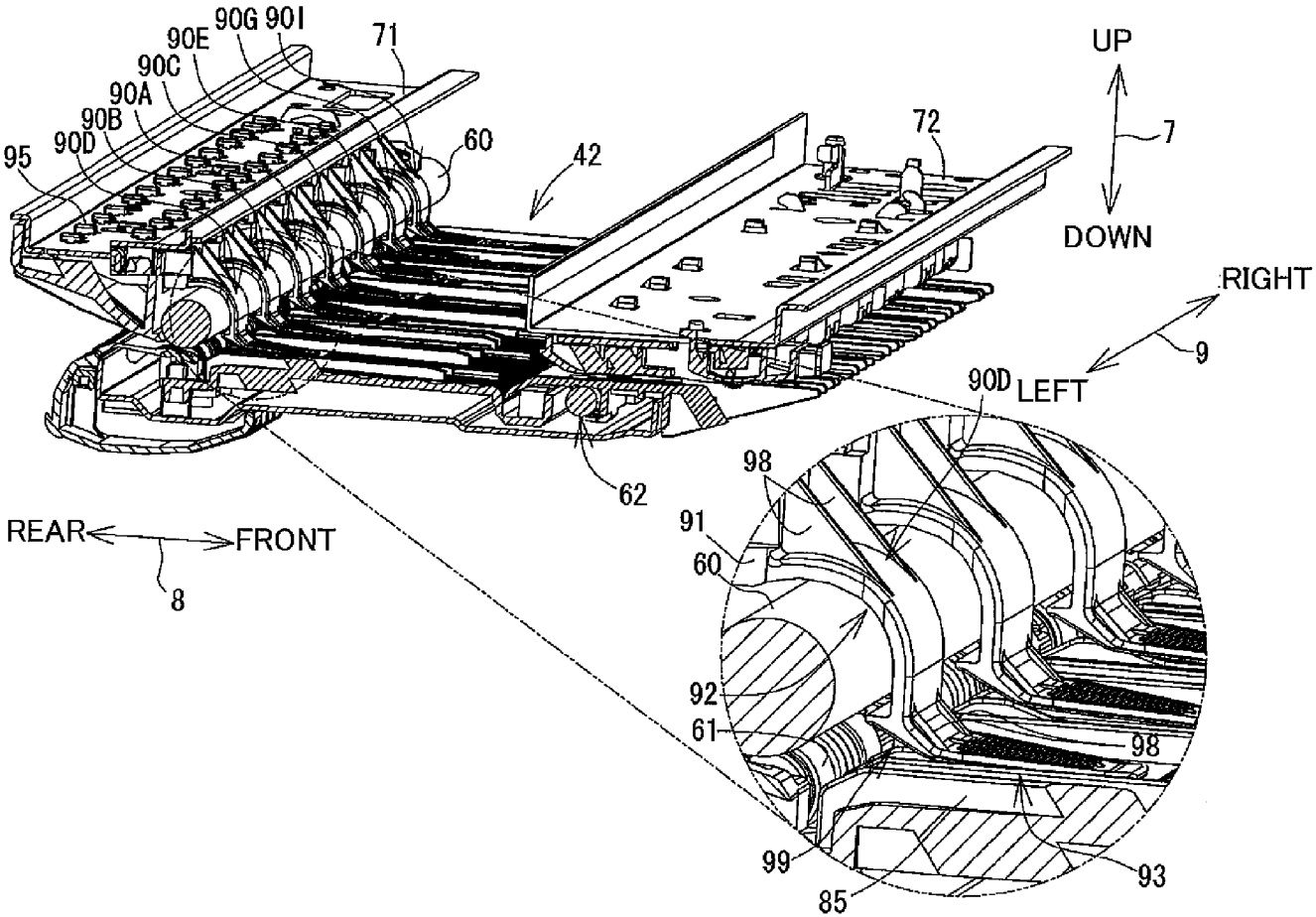
FIG. 4 shows a cross-sectional perspective view taken along a cutting plane line IV-IV shown in FIG. 3. It is noted that a recording section is omitted.
Figure 5A:
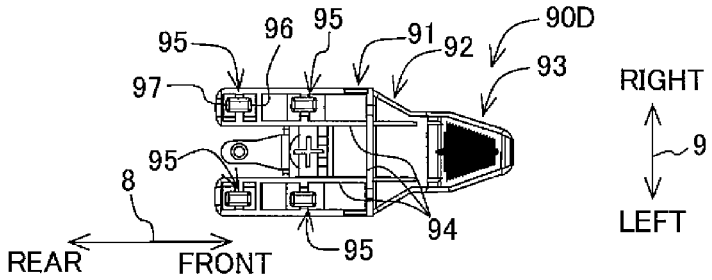
Figure 5B:
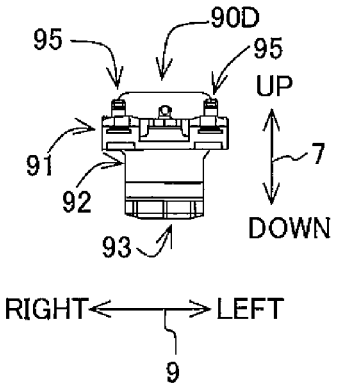
Figure 5C:
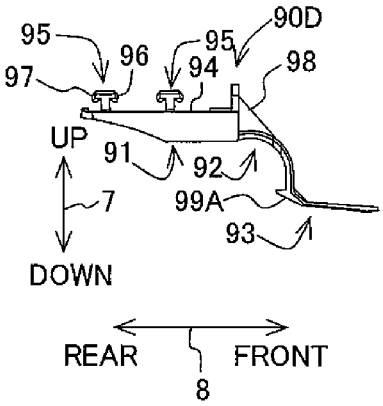
Figure 5D:
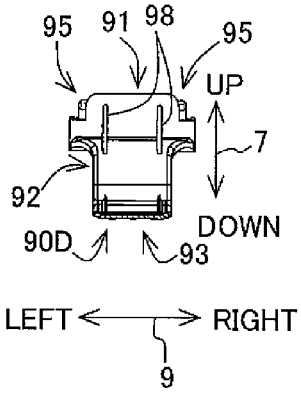
Figure 5E:
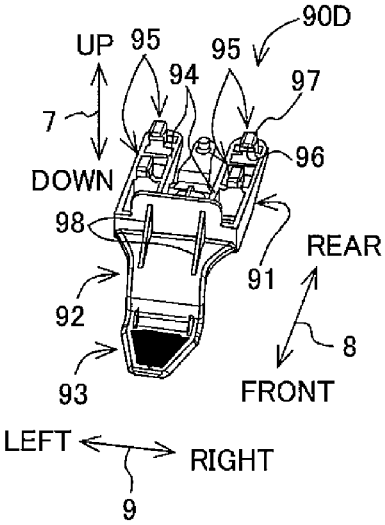
Figure 5F:
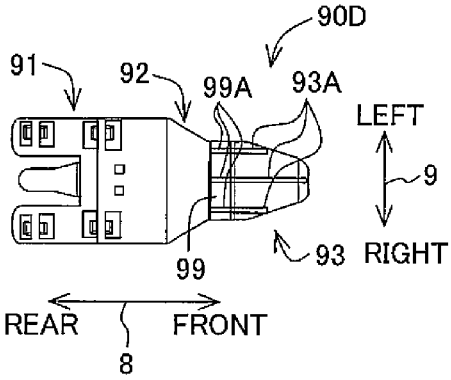

As shown in FIGS. 2 to 4, the platen 42 is provided on the just downstream side of the first roller pair 58 described above (on the front side in the front-back direction 8). The platen 42 has a support surface 84 (FIG. 3) which is directed upwardly so that the support surface 84 is opposed to the recording section 24. The support surface 84 is exposed to the transport passage 65 (FIG. 2), and the support surface 84 comparts a part of the lower surface of the transport passage 65. Ribs 85 (FIGS. 3, 4, and 7, example of the rib of the present invention) are allowed to protrude upwardly from the support surface 84. The ribs 85 extend frontwardly from the back end of the support surface 84 in the front-back direction 8 along the support surface 84. The front ends of the ribs 85 (downstream ends in the transport direction) are positioned backwardly from the nozzles 39 disposed most backwardly. The plurality of ribs 85 are provided while being separated from each other in the left-right direction 9.

<First Guide Rail 71>

The first guide rail 71 is provided while providing a predetermined spacing distance over the transport roller 60 in the vicinity of the back end of the platen 42 in the front-back direction 8. The first guide rail 71 has a generally rectangular flat plate-shaped form having the long side disposed in the left-right direction 9. The first guide rail 71 is provided so that the front and back surfaces are substantially parallel to the support surface 84 of the platen 42 respectively. The first guide rail 71 traverses the transport passage 65 in the left-right direction 9, and the first guide rail 71 is supported at the both end portions. The first guide rail 71 has a plurality of attachment sections 73A to 73I (FIGS. 3 and 6) for attaching holding members 90A to 90I (FIGS. 3 to 5, example of the holding member of the present invention) described later on respectively in the left-right direction 9. Each of the attachment sections 73A to 73I is composed of four insertion holes 74 (FIGS. 3 and 6) which penetrate through the front and back surfaces of the first guide rail 71 in the upward-downward direction 7. Insertion projections 95 (FIGS. 3 to 6) of the holding members 90A to 90I are inserted into the respective insertion holes 74, and thus the holding members 90A to 90I are attached to the first guide rail 71. All of the attachment sections 73A to 73I are not disposed at the same position in the front-back direction 8. The positions of the attachment sections 73A to 73I are deviated from each other in the front-back direction 8. Accordingly, the holding members 90A to 90I are also attached at the positions deviated from each other in the front-back direction 8. Details will be described later on.

<Holding Members 90A to 90I>

Figure 6:
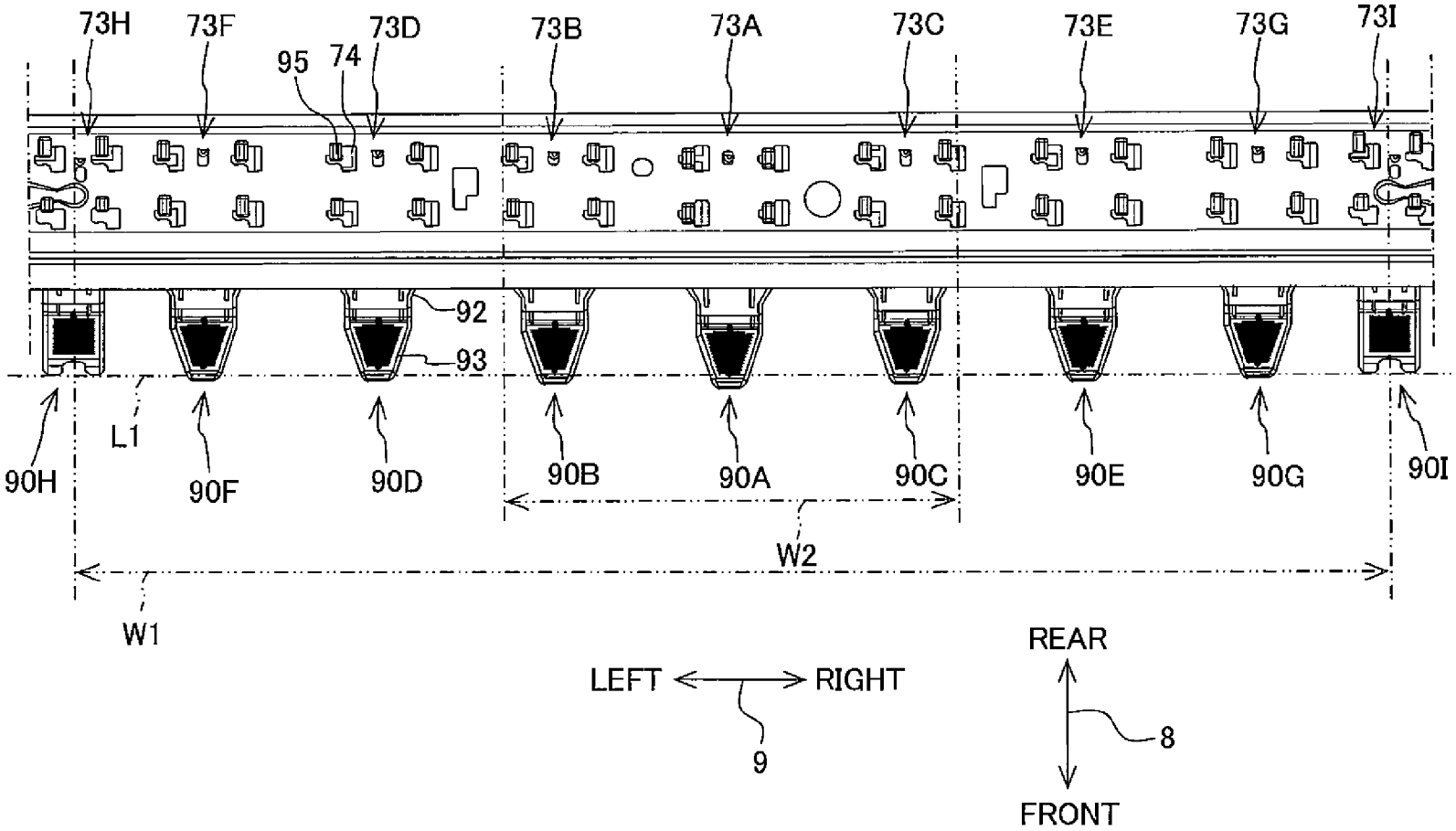
FIG. 6 shows a positional relationship of holding members.

The holding members 90A to 90I are the members which cooperate with the ribs 85 of the platen 42 so that the recording paper 35, which is to be transported, is allowed to have the wavy form (wavy shape). As shown in FIGS. 4 and 6, one holding member 90A is arranged at the center (example of the central portion in the widthwise direction of the transport passage) of the platen 42 in the left-right direction 9 (one holding member is hidden by the carriage 33 in FIG. 3). The holding members 90B to 90I are arranged while being separated by predetermined distances on the both outer sides in the left-right direction 9 of the holding member 90A. The holding member 90B and the holding member 90C, the holding member 90D and the holding member 90E, the holding member 90F and the holding member 90G, and the holding member 90H and the holding member 90I are arranged respectively at symmetrical positions with respect to the holding member 90A, for the following reason. That is, it is intended to allow the recording paper 35 to have a bilaterally symmetrical wavy form.

The holding members 90A to 90I will be explained below with reference to the respective drawings. In the following description, the holding member 90D is exemplified by way of example. However, the holding members 90A to 90C, 90E to 90G are constructed in the same manner as the holding member 90D. The holding members 90H, 90I have the shapes which are partially different from those of the holding members 90A to 90G. This difference will be described later on. The upward-downward direction 7, the front-back direction 8, and the left-right direction 9 shown in FIGS. 5A, 5B, 5D, 5E and 5F are provided as the directions as brought about in the state in which the holding members 90A to 90I are attached to the guide rails 71.

As shown in FIGS. 4 and 5, the holding member 90D is a resin molded product comprising a plate-shaped base portion 91, a curved tab 92 which extends downwardly while being curved from a front surface of the base portion 91 in the front-back direction 8, and a holding tab 93 (example of the abutment portion of the present invention) which extends obliquely downwardly in the frontward direction while being slightly inclined with respect to the horizontal surface from a lower end of the curved tab 92. A plurality of reinforcing ribs 94 for effecting the reinforcement (FIG. 5) and four insertion projections 95 (FIGS. 3 to 6) to be inserted into the insertion holes 74 (FIGS. 3, 6) of the first guide rail 71 are allowed to protrude upwardly from the upper surface of the base portion 91. The four insertion projections 95 are arranged at positions at which the insertion projections 95 are aligned two by two in the front-back direction 8 and the left-right direction 9.

A pair of front and back pawls 96, 97 (FIG. 5), which are engageable with the upper surface of the first guide rail 71, are provided at the forward end portion (upper end portion) of the protrusion of the insertion projection 95. The pawl 96 protrudes frontwardly in the front-back direction 8 from the forward end portion (upper end portion) of the protrusion of the insertion projection 95. The pawl 97 protrudes backwardly in the front-back direction 8 from the forward end portion (upper end portion) of the protrusion of the insertion projection 95. When the holding member 90D is attached, then the insertion projection 95 is inserted into the insertion hole 74 from the lower side of the first guide rail 71, and then the insertion projection 95 is allowed to slide leftwardly in the left-right direction 9. The inner diameter of the left portion of the insertion hole 74 is smaller than that of the right portion. Therefore, a state is given, in which the pawls 96, 97 are fitted into the insertion hole 74. Thus, the holding member 90D is fixed to the first guide rail 71.

The curved tab 92 is curved in a circular arc-shaped form, for the following reason. That is, it is intended to avoid the contact of the curved tab 92 with the first transport roller 60. The curved tab 92 is reinforced by reinforcing ribs 98 so that the curved tab 92 is not flexibly bent.

An inclined surface 99, which is inclined obliquely downwardly in the frontward direction from the front side in the front-back direction 8 of the nip position of the first roller pair 58, is provided at the lower end portion of the curved tab 92. A plurality of guide ribs 99A (FIG. 5) are provided on the inclined surface 99 to extend in the direction (obliquely downwardly in the frontward direction) in which the inclined surface 99 is inclined. The plurality of guide ribs 99A are arranged while being separated from each other in the left-right direction 9. The downstream end of the recording paper 35 in the transport direction is guided to the holding tab 93 by the forward ends of the protrusion of the guide ribs 99A.

The holding tab 93 is formed to have the plate-shaped form which is slightly inclined with respect to the horizontal surface so that the front end in the front-back direction 8 is positioned downwardly as compared with the back end. The front end (downstream end in the transport direction) of the holding tab 93 in the front-back direction 8 is positioned at the back of the nozzles 39 of the recording head 34 in the front-back direction 8, and the front end of the holding tab 93 is disposed closely to the nozzles 39.

Figure 7:
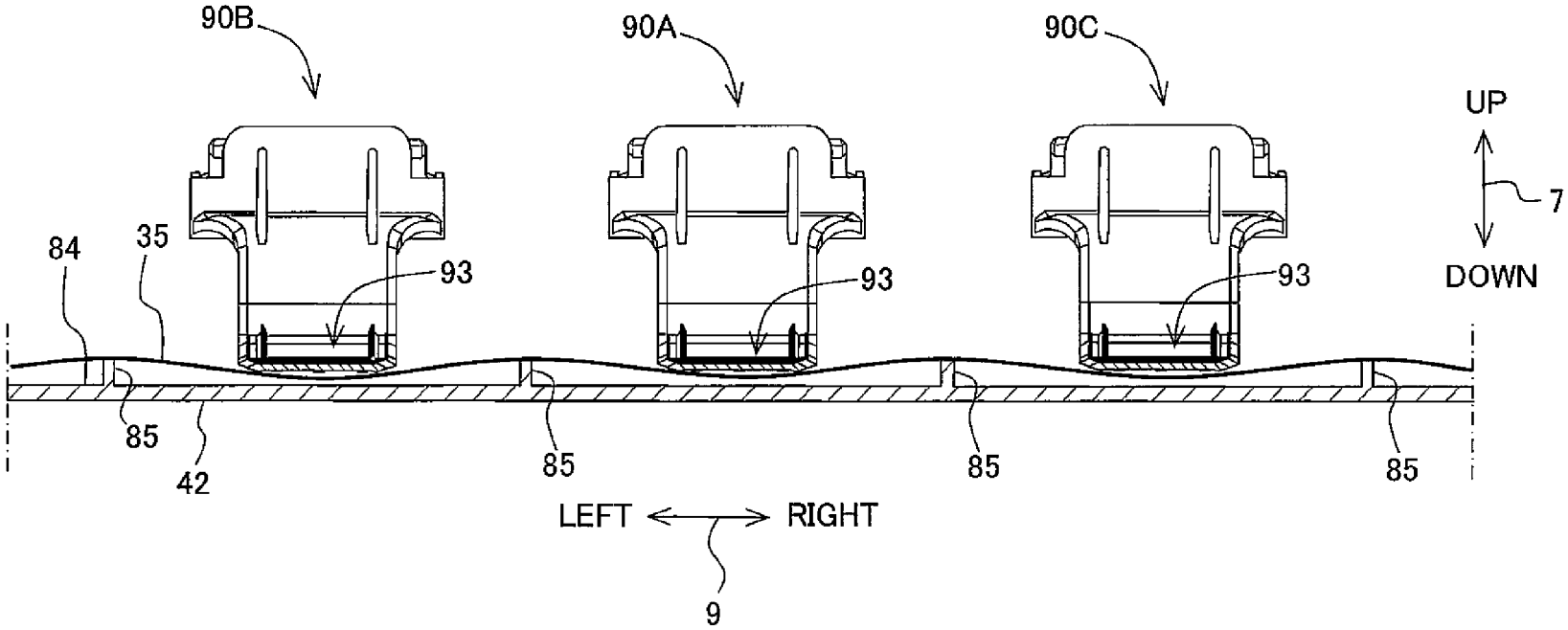
FIG. 7 shows a situation in which the recording paper is allowed to have a wavy form by means of the holding members and ribs.

The reason, why the holding tab 93 is inclined, is that it is intended not to jam the transported recording paper 35 between the holding tab 93 and the support surface 84 of the platen 42 (FIGS. 3, 7). The reason, why the holding tab 93 is plate-shaped, is that it is intended to arrange the holding tab 93 in the small gap between the recording head 34 and the support surface 84 of the platen 42. The reason, why the front end of the holding tab 93 in the front-back direction 8 is disposed closely to the nozzles 39, is that it is intended to improve the accuracy of the image recording by holding the recording paper 35 at the position disposed closely to the nozzles 39. In this embodiment, the lower surface of the holding tab 94 for holding the recording paper 35 is an example of the abutment surface of the present invention.

The holding tab 93 is allowed to have a tapered shape in which the both ends in the left-right direction 9 are inclined to approach to one another at positions disposed more frontwardly in the front-back direction so that the holding tab 93 is elastically deformed with ease in the upward-downward direction 7. The front end portion of the holding tab 93 is flexibly bent when the transported recording paper 35 is allowed to have the wavy shape. The holding tab 93 is also flexibly bent when the recording paper 35 having a slightly thick thickness is transported or when a plurality of sheets of the recording paper 35 are fed in a superimposed manner. Thus, the recording paper 35 is suppressed from being jammed between the holding tab 93 and the platen 42.

As shown in FIGS. 3 and 6, as for the holding members 90H, 90I, the portion for holding the recording paper 35 has the shape which is different from the shape of each of the holding members 90A to 90G. In particular, in the case of the holding members 90H, 90I, the portion, which corresponds to the holding tab 93 of each of the holding members 90A to 90G, does not have the tapered shape, and the portion has a generally rectangular shape. The holding members 90H, 90I are provided to hold the both left and right ends of the recording paper 35 on the both outer sides in the left-right direction 9. Therefore, the wide width shape is adopted for the holding tab 93 in order to prevent the end portion of the recording paper 35 from being deviated inwardly in the left-right direction 9 during the transport.

<Positional Relationship of Holding Members 90A to 90I>

As described above, the positions of the attachment sections 73A to 73I of the first guide rail 71 are deviated from each other in the front-back direction 8. Therefore, the holding members 90A to 90I, i.e., the front ends of the holding tabs 93 have the positions which are also deviated from each other in the front-back direction 8 in the same manner. An explanation will be made in detail below with reference to FIG. 6. In FIG. 6, the positions of the front ends of the holding tabs 93 of the holding members 90H, 90I positioned at the most backward positions are indicated by a line L1 which is a virtual straight line.

The attachment section 73A of the first guide rail 71, which corresponds to the holding member 90A positioned at the most central position in the left-right direction 9, is positioned frontwardly in the front-back direction 8 as compared with any one of the other attachment sections 73B to 73I. Therefore, as shown in FIG. 6, the holding member 90A, which is positioned at the most central position in the left-right direction 9 (example of the central portion in the widthwise direction of the transport passage), has the front end of the holding tab 93 which is positioned frontwardly in the front-back direction 8 as compared with the front end of the holding tab 93 of any one of the other holding members 90B to 90I. In other words, the holding member 90A protrudes most frontwardly with respect to the line L1.

The attachment sections 73B, 73C, which correspond to the holding members 90B, 90C provided adjacently on the both outer sides of the holding member 90A respectively, are positioned slightly backwardly in the front-back direction 8 as compared with the attachment section 73A. Therefore, as for the holding members 90B, 90C, the front ends of the holding tabs 93 are positioned slightly backwardly in the front-back direction 8 as compared with the front end of the holding tab 93 of the holding member 90A. In other words, the length of frontward protrusion from the line L1 is shorter than that of the holding member 90A.

The attachment sections 73D, 73E, which correspond to the holding members 90D, 90E provided adjacently on the both outer sides of the holding members 90B, 90C respectively, are positioned slightly backwardly in the front-back direction 8 as compared with the attachment sections 73B, 73C. Therefore, as for the holding members 90D, 90E, the front ends of the holding tabs 93 are positioned slightly backwardly in the front-back direction 8 as compared with the front ends of the holding tabs 93 of the holding members 90B, 90C. In other words, the lengths of frontward protrusion from the line L1 are shorter than those of the holding members 90B, 90C.

The attachment sections 73F, 73G, which correspond to the holding members 90F, 90G provided adjacently on the both outer sides of the holding members 90D, 90E respectively, are positioned slightly backwardly in the front-back direction 8 as compared with the attachment sections 73D, 73E. Therefore, as for the holding members 90F, 90G, the front ends of the holding tabs 93 are positioned slightly backwardly in the front-back direction 8 as compared with the front ends of the holding tabs 93 of the holding members 90D, 90E. In other words, the lengths of frontward protrusion from the line L1 are shorter than those of the holding members 90E, 90E.

The attachment sections 73H, 73I, which correspond to the holding members 90H, 90I provided adjacently on the both outer sides of the holding members 90F, 90G respectively, are positioned slightly backwardly in the front-back direction 8 as compared with the attachment sections 73F, 73G. Therefore, as for the holding members 90H, 90I, the front ends of the holding tabs 93 are positioned slightly backwardly in the front-back direction 8 as compared with the front ends of the holding tabs 93 of the holding members 90F, 90G. As described above, the line L1 is defined on the basis of this position.

According to the foregoing description, the holding members, which are provided on the more outer sides in the left-right direction 9, have the front ends of the holding tabs 93 which are positioned more backwardly in the front-back direction 8. The two holding members, which are provided at the symmetrical positions with respect to the holding member 90A, have the front ends of the holding members 93 which are positioned at the same position in the front-back direction 8. In other words, the front ends of the holding tabs 93 are positioned at the same position in the front-back direction 8 in relation to the set of the holding member 90B and the holding member 90C, the set of the holding member 90D and the holding member 90E, the set of the holding member 90F and the holding member 90G, and the set of the holding member 90H and the holding member 90I respectively.

However, as shown in FIG. 6, the holding tabs 93 of the respective holding members 90A to 90I are in such a state that they are overlapped at least partially in the front-back direction 8 as viewed in the left-right direction 9. In other words, the holding members 90A to 90I are not greatly deviated to such an extent that the holding tabs 93 are separated from each other in the front-back direction 8.

The distance, by which the holding members 90A to 90I are deviated in the front-back direction 8, can be arbitrarily determined by those skilled in the art. For example, in this embodiment, the mutually adjoining holding members are deviated from each other in the front-back direction 8 by about 2 mm. Therefore, the holding member 90A and the holding members 90H, 90I are deviated from each other by about 8 mm.

<Transport of Recording Paper 35>

The printer unit 11 according to the present invention can record the image on at least two types of the recording paper 35 having different sizes. The size of the recording paper 35 on which the image can be recorded can be appropriately determined by those skilled in the art. However, for example, the size is exemplified by A size, B size, L size (89×127 mm), and postcard size (100.0×148.0 mm). In this embodiment, the larger sheet of the two types of the sheets of the recording paper 35 is designated as the recording paper 35 of the first size (example of the first sheet), and the smaller sheet is designated as the recording paper 35 of the second size (example of the second sheet).

The width in the left-right direction 9 in the transport state of the recording paper 35 of the first size is slightly shorter than the width of the transport passage 65 in the left-right direction 9. The first range W1, which is occupied in the left-right direction 9 by the recording paper 35 of the first size during the transport, is shown in FIG. 6. The first range W1 extends approximately from the center of the holding member 90H approximately to the center of the holding member 90I. When the recording paper 35 is transported on the platen 42, then the recording paper 35 of the first size passes under all of the holding members 90A to 90I respectively, and the recording paper 35 of the first size is pressed by the holding members 90A to 90I respectively.

On the other hand, the width in the left-right direction 9 in the transport state of the recording paper 35 of the second size is further shorter than that of the recording paper 35 of the first size. The second range W2, which is occupied in the left-right direction 9 by the recording paper 35 of the second size during the transport, is shown in FIG. 6. The second range W2 extends from the left side of the holding member 90B to the right side of the holding member 90C. In other words, the recording paper 35 of the second size passes under the holding members 90A to 90C (examples of the at least three holding members) respectively, and the recording paper 35 of the second size is pressed by the holding members 90A to 90C respectively.

At first, an explanation will be made about the situation in which the recording paper 35 of the first size is transported through the surroundings of the platen 42. The recording paper 35 is transported along the transport passage 65, and the recording paper 35 is supplied to the recording section 24. During the process in which the recording paper 35 is transported along the transport passage 65, the recording paper 35 is in a state of being interposed between the first roller pair 58. After the recording paper 35 is interposed between the first roller pair 58, the downstream end of the recording paper 35 (front end in the front-back direction 8) is fed onto the platen 42. When the downstream end of the recording paper 35 arrives at the holding tabs 93 of the holding members 90A to 90I, then the recording paper 35 is in a state of being interposed by the ribs 85 of the platen 42 and the holding tabs 93 of the holding members 90A to 90I, and the recording paper 35 is curved in the wavy form in the left-right direction 9 as shown in FIG. 7.

After the downstream end of the recording paper 35 passes through the respective holding tabs 93, the upstream side is still in a state of being interposed by the ribs 85 and the holding tabs 93 of the holding members 90A to 90I. Therefore, the wavy form of the recording paper 35 is maintained around the platen 42. The recording paper 35 is transported on the plate 42 in this state.

When a part of the recording paper 35 passes under the recording head 34, the image is recorded thereon. After the downstream end of the recording paper 35 passes under the recording head 34, the downstream end of the recording paper 35 is in a state of being interposed by the second roller pair 59. In other words, the recording paper 35 is interposed by the first roller pair 58 on the upstream side from the recording head 34, and the recording paper 35 is interposed by the second roller pair 59 on the downstream side from the recording head 34. The recording paper 35 is transported by the transporting forces of the rollers.

Subsequently, when the upstream end of the recording paper 35 passes through the first roller pair 58, the recording paper 35 is in a state of being interposed by only the second roller pair 59. The upstream end of the recording paper 35 passes under the holding members 90A to 90I respectively by the transporting force of the second transport roller 62, and the recording paper 35 is released from the wavy form. All portions of the recording paper 35 pass under the recording head 34, and thus the recording of the image is completed. The recording paper 35, which has passed through the platen 42, is transported toward the third roller pair 44.

In this embodiment, the holding members 90A to 90I are in the positional relationship as described above respectively. Therefore, when the upstream end of the recording paper 35 passes through the holding members 90A to 90I, the upstream end of the recording paper 35 is released earlier from the pressing action exerted by the holding members 90A to 90I which are disposed on the more outer sides in the left-right direction 9. In other words, the upstream end of the recording paper 35 firstly passes through the downstream ends of the holding tabs 93 of the holding members 90H, 90I, and the upstream end of the recording paper 35 is released from the pressing action exerted by the holding members 90H, 90I. Subsequently, the upstream end of the recording paper 35 passes through the downstream ends of the holding tabs 93 of the holding members 90F, 90G, and the upstream end of the recording paper 35 is released from the pressing action exerted by the holding members 90F, 90G. Subsequently, the upstream end of the recording paper 35 passes through the downstream ends of the holding tabs 93 of the holding members 90D, 90E, and the upstream end of the recording paper 35 is released from the pressing action exerted by the holding members 90D, 90E. Subsequently, the upstream end of the recording paper 35 passes through the downstream ends of the holding tabs 93 of the holding members 90B, 90C, and the upstream end of the recording paper 35 is released from the pressing action exerted by the holding members 90B, 90C. Subsequently, the upstream end of the recording paper 35 passes through the downstream end of the holding tab 93 of the holding member 90A, and the upstream end of the recording paper 35 is released from the pressing action exerted by the holding member 90A. In accordance with the flow as described above, the recording paper 35 completely passes through the holding members 90A to 90I.

Subsequently, an explanation will be made about the situation in which the recording paper 35 of the second size is transported through the surroundings of the platen 42. The flow of the transport of the recording paper 35 of the second size is the same as or equivalent to that of the recording paper 35 of the first size, and hence duplicate portions are omitted from the explanation. The transport of the recording paper 35 of the second size is different from the transport of the recording paper 35 of the first size in that the holding members, which press and curve the recording paper 35, are only the three holding members 90A to 90C.

During the process of the transport, the recording paper 35 is in a state of being pressed by the holding members 90A to 90C respectively. When the recording paper 35 passes through the holding members 90A to 90C, then the upstream end of the recording paper 35 firstly passes through the downstream ends of the holding tabs 93 of the holding members 90B, 90C, and the upstream end of the recording paper 35 is released from the pressing action exerted by the holding members 90B, 90C. Subsequently, the upstream end of the recording paper 35 passes through the downstream end of the holding tab 93 of the holding member 90A, and the upstream end of the recording paper 35 is released from the pressing action exerted by the holding member 90A. In accordance with the flow as described above, the recording paper 35 completely passes through the holding members 90A to 90I.

As described above, according to this embodiment, the recording paper 35 is released earlier from the pressing action exerted by the holding members which are disposed on the more outer sides in the left-right direction 9, and the recording paper 35 is released at last from the pressing action exerted by the holding member 90A, even when the recording paper 35 has any size of the first size and the second size.

<Function and Effect of Embodiment>

Figure 8A:
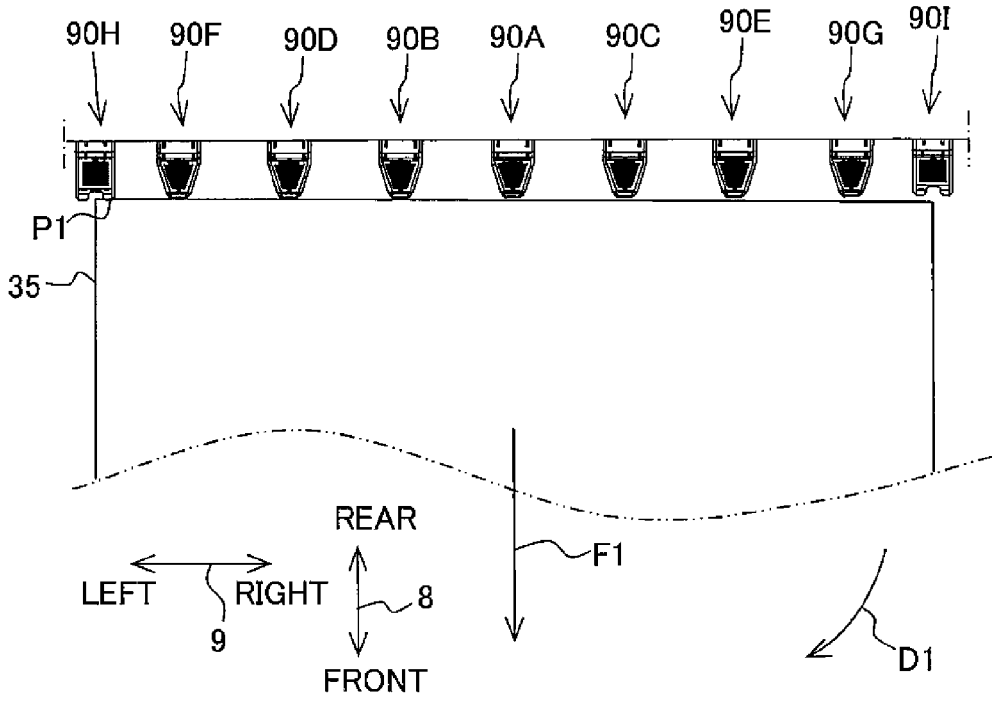
FIGS. 8A and 8B show a situation in which the recording paper is inclined during the transport in a conventional arrangement.
Figure 8B:
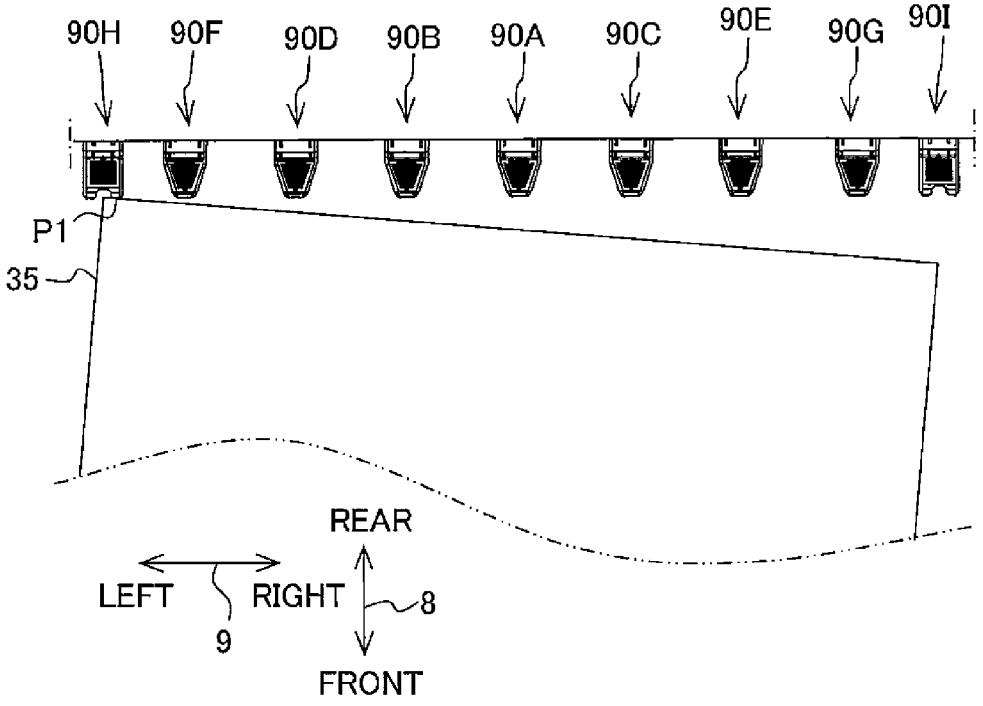

In the case of any conventional arrangement in which the holding members 90A to 90I are aligned in one array in the left-right direction 9, the pressing action, which is exerted on the recording paper 35 by the holding member 90H or the holding member 90I, is maintained to the last during the process in which the recording paper 35 passes through the holding members 90A to 90I. The situation as described above tends to arise especially when the recording paper 35 is slightly inclined. For example, in an example shown in FIG. 8A, the recording paper 35 is inclined so that the left side is positioned slightly on the upstream side. In this case, the pressing action, which is exerted by the pressing member 90H, is maintained to the last. In this situation, a part of the force F1 for transporting the recording paper 35 by the second roller pair 59 is converted into the force for rotating the recording paper 35 in the clockwise direction D1 about the support point of the pressing position P1 at which the pressing action is exerted by the holding member 90H. In other words, the angular moment (rotation moment) acts to rotate the recording paper 35. On account of the angular moment (rotation moment), the recording paper 35 is inclined more greatly as shown in FIG. 8B.

According to this embodiment, the recording paper 35 is released earlier from the pressing action exerted by the holding members which are disposed on the more outer sides in the left-right direction 9, and the recording paper 35 is released at last from the pressing action exerted by the holding member 90A, even when the recording paper 35 has any size of the first size and the second size. The holding member 90A is provided at the most central position in the left-right direction 9. Therefore, even if the force in the transport direction is exerted by the second roller pair 59 in the state in which the recording paper 35 is pressed by only the holding member 90A, the force does not act as the angular moment (rotation moment) to rotate the recording paper 35.

The holding tabs 93 of the respective holding members 90A to 90I are in the state of being overlapped with each other at least partially in the front-back direction 8 as viewed in the left-right direction 9. Therefore, the upstream end of the recording paper 35 is in the state of being pressed by any one of the holding members 90A to 90I until the recording paper 35 completely passes through the holding members 90A to 90I. Accordingly, the possibility of the action of the angular moment (rotation moment) to rotate the recording paper 35 is further reduced.

Parts of the holding tabs 93 of the holding members 90A to 90I are positioned downwardly as compared with the upper ends of the ribs 85 of the platen 42. Therefore, the recording paper 35, which is interposed by the holding tabs 93 and the ribs 85, is curved into the wavy form in the left-right direction 9. Accordingly, the strength of the recording paper 35 is strengthened with respect to the bending in the transport direction, and the recording paper 35 is prevented from the floating from the platen 42.

Modified Embodiments

Figure 9:
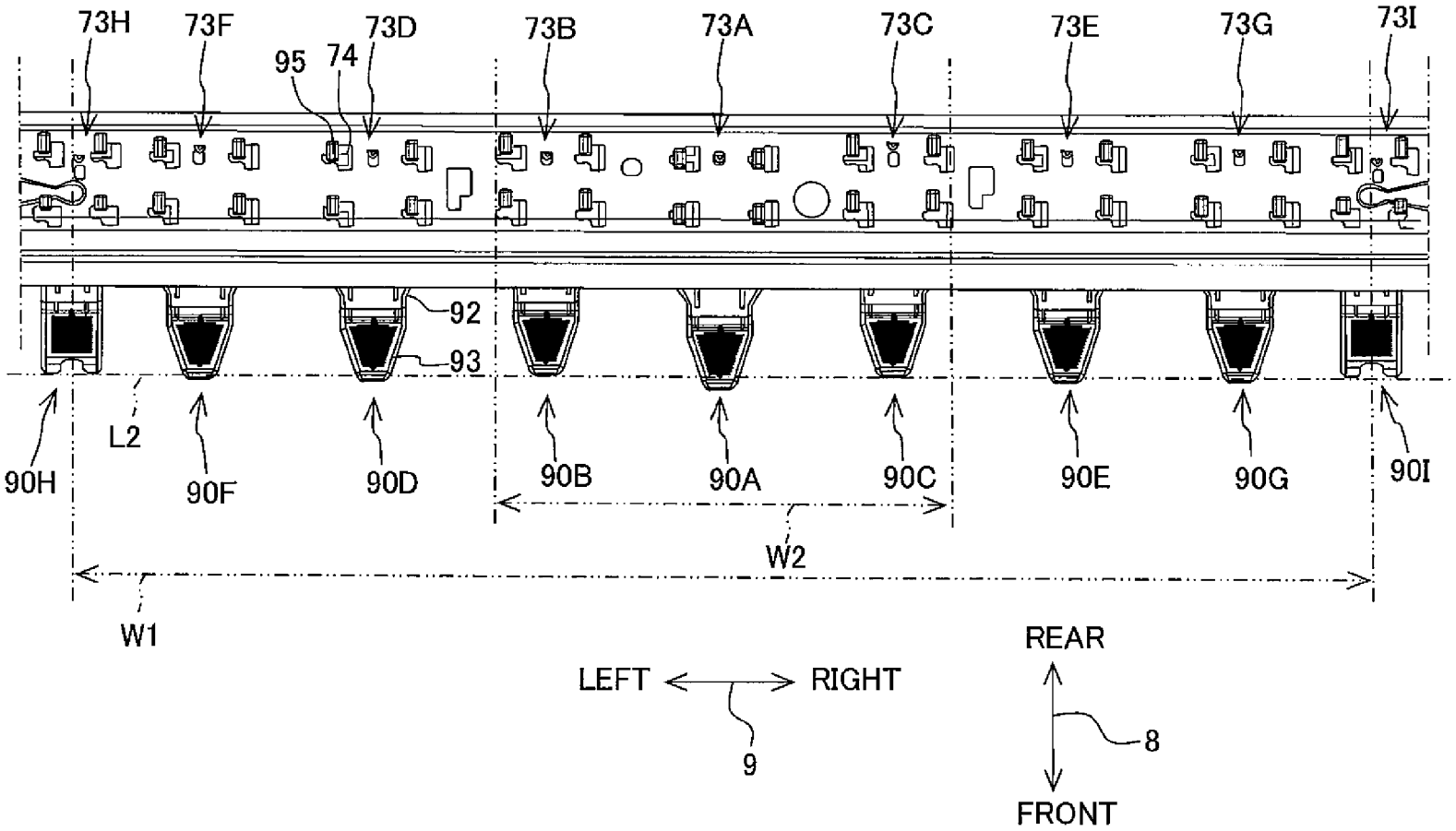
FIG. 9 shows a positional relationship of holding members in a modified embodiment of the multifunction machine.

In the embodiment described above, the holding members 90A to 90I, which are disposed on the more outer side in the left-right direction 9, are provided on the more upstream side in the transport direction. However, on condition that the central holding member 90A is provided on the most downstream side in the transport direction, it is also allowable that the positions of the other holding members 90B to 90I are somewhat different from those of the embodiment described above. For example, as shown in FIG. 9, the holding members 90A, 90D to 90I, which are disposed on the more outer side in the left-right direction 9, may be provided on the more upstream side in the transport direction, and the holding members 90B, 90C may be provided at the same positions as those of the holding members 90H, 90I in the transport direction. In FIG. 9, the positions of the front ends of the holding tabs 93 of the holding members 90H, 90I are indicated by a line L2 which is a virtual straight line.

Alternatively, the holding members 90B to 90I may be provided at the same position in the transport direction, and they may be aligned in one array in the left-right direction 9. In this case, only the holding member 90A is provided on the downstream side in the transport direction as compared with the other holding members 90B to 90I.

Further alternatively, it is also allowable that the holding member 90A is not provided, and the holding members 90B, 90C are provided while being deviated toward the vicinity of the center in the left-right direction 9 (example of the central portion in the widthwise direction of the transport passage). In this case, the holding members 90B, 90C are provided at the same position in the transport direction, and they are provided on the downstream side in the transport direction as compared with the other holding members 90D to 90I. In other words, it is also allowable that a plurality of holding members are arranged on the most downstream side in the transport direction.

In the embodiment described above, the sheet of the second size is transported under the three central holding members 90A to 90C. However, the range W2 in the left-right direction 9, which is occupied by the sheet of the second size, may be deviated from the center of the transport passage 65. For example, the sheet of the second size may be transported under the three holding members 90C, 90E, 90G on the right side from the center of the transport passage 65 in the left-right direction 9. In this case, the central holding member 90E of the holding members 90C, 90E, 90G is provided on the most downstream side in the transport direction. As for all of the holding members 90A to 90E, the holding member 90A is provided on the most downstream side.

In the embodiment described above, the holding tabs 93 of the holding members 90A to 90I may be elastically urged toward the support surface 84 of the platen 42 by means of the curved tabs 92. In this case, the holding member 90A may have the largest urging force. Accordingly, the recording paper 35 is pressed by the largest force at the central position in the left-right direction 9. Therefore, the recording paper 35 is hardly inclined in the form as described above, and the transport is stabilized.

In the embodiment described above, the nine holding members 90A to 90I are provided. However, the number of holding members is appropriately changed depending on the width of the transport passage 65 in the left-right direction 9 and the size or dimension of the recording paper 35 to be transported.

In the embodiment described above, the holding members 90A to 90I are attached to the first guide rail 71 respectively. However, the holding members 90A to 90I may be constructed as an integrated member integrated with the first guide rail 71. Further, the holding members 90A to 90I may be supported by any member different from the first guide rail 71, and the holding members 90A to 90I may be arranged for the transport passage 65.

In the embodiment described above, the plurality of ribs 85 are provided depending on the places between the respective holding members 90A to 90I adjoining in the left-right direction 9. However, a larger number of ribs 85 may be provided, or only one rib 85 may be provided between the respective adjoining holding members 90A to 90I.

In the embodiment described above, each of the holding members 90A to 90I is constructed by the base portion 91, the curved tab 92, and the holding tab 93. However, the shape of each of the holding members 90A to 90I is not limited to the shape described in the foregoing embodiment provided that the recording paper 35 can be pressed. For example, the respective holding members 90A to 90I may be a plurality of rollers or spurs which abut against the recording paper 35 from the upward positions to press the recording paper 35 downwardly. In this case, the positional relationship of the rollers or the spurs are the same as or equivalent to that of the holding members 90A to 90I in the embodiment described above. In other words, the rollers or the spurs, which are disposed at the more central positions in the left-right direction 9, are provided on the more downstream side in the transport direction. The outer circumferential portions of the plurality of rollers or the plurality of spurs, which abut against the recording paper 35, correspond to the abutment portion of the present invention.

What is claimed is:

1. An image recording apparatus comprising:

a roller pair configured to nip a sheet therebetween and transport the sheet in a transport direction;

a recording section provided downstream of a nip point of the roller pair in the transport direction and including nozzles that discharge ink to the sheet;

a platen provided below the recording section and configured to support the sheet; and a plurality of abutment portions arranged in a widthwise direction perpendicular to the transport direction and configured to abut against an upper surface of the sheet, wherein an end of each of the plurality of abutment portions is positioned at a gap between the recording section and the platen, wherein the plurality of abutment portions includes: a first abutment portion configured to abut against an edge of the sheet in the widthwise direction; and a second abutment portion configured not to abut against the edge of the sheet in the widthwise direction, and wherein a width of the first abutment portion is wider than a width of the second abutment portion in the widthwise direction.

2. The image recording apparatus according to claim 1, wherein the first abutment portion is located in the most outside among the plurality of abutment portions in the widthwise direction.

3. The image recording apparatus according to claim 1, wherein the end of each of the plurality of abutment portions is positioned at upstream of the nozzles in the transport direction.

4. The image recording apparatus according to claim 3, wherein the end of each of the plurality of abutment portions is disposed closely to the nozzles in the transport direction.

* * * * *